US008858369B2

(12) United States Patent
Murphy

(10) Patent No.: US 8,858,369 B2
(45) Date of Patent: Oct. 14, 2014

(54) BASEBALL HOLDER FOR A BATTING TEE

(76) Inventor: Luke Murphy, San Francisco, CA (US)

( * ) Notice: Subject to any disclaimer, the term of this patent is extended or adjusted under 35 U.S.C. 154(b) by 45 days.

(21) Appl. No.: 13/595,808

(22) Filed: Aug. 27, 2012

(65) Prior Publication Data

US 2013/0196793 A1 Aug. 1, 2013

Related U.S. Application Data

(60) Provisional application No. 61/591,812, filed on Jan. 27, 2012.

(51) Int. Cl.
*A63B 71/00* (2006.01)
*A63B 69/00* (2006.01)

(52) U.S. Cl.
CPC ..... *A63B 69/0075* (2013.01); *A63B 69/0002* (2013.01); *A63B 2069/0008* (2013.01)
USPC ..... 473/417

(58) Field of Classification Search
CPC ..... A63B 57/0018; A63B 57/00; A63B 57/0043; A63B 2069/0008; A63B 69/002
USPC ..... 473/417, 422, 451, 387; 482/148; D21/717, 718
See application file for complete search history.

(56) References Cited

U.S. PATENT DOCUMENTS 1,781,757 A * 11/1930 Holden ..... 473/387
4,989,866 A 2/1991 Dill
D369,845 S 5/1996 Knez
D417,961 S 12/1999 Powis, Jr.
6,053,822 A * 4/2000 Kolodney et al. ..... 473/387
6,413,175 B1 * 7/2002 Mooney, Jr. ..... 473/417
D491,619 S * 6/2004 Crouse ..... D21/718
7,204,769 B2 * 4/2007 Bandimere et al. ..... 473/417
D566,801 S * 4/2008 Grant ..... D21/717
8,109,844 B1 2/2012 Quinn
2004/0166964 A1 * 8/2004 Toyosawa et al. ..... 473/387
2005/0003907 A1 * 1/2005 Ijiri ..... 473/387
2005/0070378 A1 * 3/2005 Parks et al. ..... 473/387
2005/0148410 A1 * 7/2005 DeLisle et al. ..... 473/387
2005/0187041 A1 * 8/2005 Kawashima et al. ..... 473/387
2006/0019773 A1 1/2006 Newman
2006/0264273 A1 * 11/2006 Liao ..... 473/417
2007/0149324 A1 * 6/2007 Tsai ..... 473/387
2007/0275793 A1 * 11/2007 Liao ..... 473/417
2009/0312123 A1 * 12/2009 Liao ..... 473/417
2010/0179003 A1 * 7/2010 Steinhobel ..... 473/387
2011/0136592 A1 6/2011 Keller (Continued)

OTHER PUBLICATIONS http://www.swing-smarter-baseball-hitting-drills.com/physics-of-hitting-a-baseball.html, "Economy of motion with NO wasted movement (swinging Down & Through)", printed from internet Aug. 27, 2012, 3 pages.

(Continued)

*Primary Examiner* — Mitra Aryanpour
(74) *Attorney, Agent, or Firm* — Mahamedi Paradice LLP

(57) ABSTRACT

A baseball holder for a batting tee is disclosed. The baseball holder includes a body to couple the baseball holder to the batting tee, and a plurality of supporting members that extend out from the body to suspend a baseball. The plurality of supporting members cooperates to define an unimpeded zone to enable the baseball to be struck off the baseball holder in a direction having at least a partially downward trajectory.

14 Claims, 9 Drawing Sheets

(56) References Cited

U.S. PATENT DOCUMENTS

| | | | | |
|---|---|---|---|---|
| 2011/0136593 | A1 | 6/2011 | Keller et al. | |
| 2012/0264548 | A1* | 10/2012 | Liao | 473/417 |
| 2013/0178313 | A1* | 7/2013 | Meier et al. | 473/417 |

OTHER PUBLICATIONS http://www.baseballcorner.com/battingtips.asp, "Stay on top of the ball. A slight downward swing allows this and is a good way to keep from upper-cutting," (Cal Ripken, Sr.), printed from internet Aug. 27, 2012, 4 pages.

* cited by examiner

BASEBALL HOLDER FOR A BATTING TEE

CROSS-REFERENCE TO RELATED APPLICATIONS

This application claims benefit of priority to U.S. Provisional Patent Application No. 61/591,812, filed on Jan. 27, 2012, titled "Improved Batting Tee." The priority application is hereby incorporated by reference in its entirety.

TECHNICAL FIELD

The disclosed embodiments relate generally to a batting tee used by individuals for batting practice or baseball training.

BACKGROUND

Batting tees are typically used by baseball or softball players to practice their swings. In addition, coaches can hit a baseball off a batting tee towards players in the field so that players can practice fielding various positions. Generally, batting tees can have a cup-shaped or funnel-shaped holder to hold a baseball on a stand.

DETAILED DESCRIPTION

Embodiments described herein include a baseball holder for a batting tee that enables a baseball to be hit in a partially downward direction. In some examples, the baseball holder includes one or more supporting members for suspending the baseball, while defining an unimpeded zone in which the baseball can be struck off the holder in a partially downward trajectory.

In examples described herein, the baseball holder can include a body to couple the baseball holder to a batting tee. The baseball holder can include a plurality of supporting members that extend out from the body to suspend or hold a baseball. Each of the supporting members can include a first end to couple to the base and a second end that makes contact with the baseball when the baseball is suspended by the baseball holder. The second ends of the supporting members can be spaced apart from each other and cooperate to define an unimpeded zone to enable the baseball to be struck off the baseball holder in a direction having at least a partially downward trajectory.

According to some embodiments, the baseball holder can be detachable from the batting tee. The body of the baseball holder can include one or more coupling mechanisms to couple to a stand of the batting tee. The body of the baseball holder can also be rotated relative to the batting tee so that the baseball can be hit off the baseball holder in various directions.

In some embodiments, the supporting members can be formed of a resilient material that can be semi-flexible. The resilient material enables the supporting members to bend or flex in different ways or magnitudes to allow for the supporting members to suspend the baseball. In this manner, the supporting members can flex or move between an unloaded position (e.g., when the baseball is not held or suspended by the supporting members) and a loaded position (e.g., when the baseball is suspended by the supporting members). The resilient material also enables the supporting members to be struck by a bat and not break or snap off the base of the baseball holder.

Still further, in one or more embodiments, the supporting members of the baseball holder can be manipulated by the user to after the position of the baseball relative to the baseball holder when it is suspended by the supporting members.

Figure 1A:
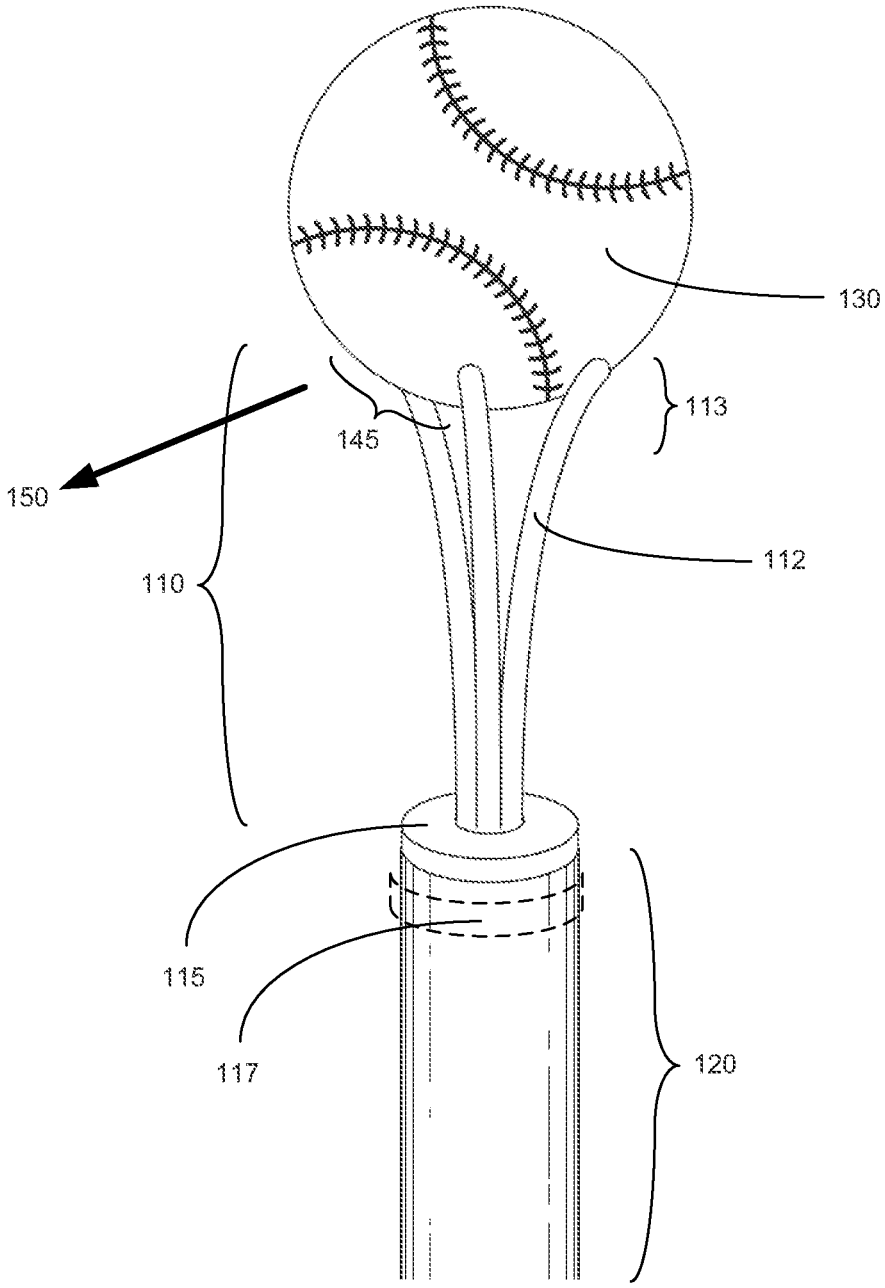
FIGS. 1A-1C illustrate an example baseball holder for a batting tee under different views.

FIG. 1A illustrates an example baseball holder for a batting tee from a side perspective view. In various implementations, a baseball holder can suspend or hold a baseball, a softball, a tennis ball, a wiffle ball, or other types of balls or rounded objects. In FIG. 1A, the baseball holder 110 is suspending or holding a baseball 130 (e.g., the baseball 130 is ready to be hit by a batter).

The baseball holder 110 can include a body 115 (e.g., a platform or mount) and a plurality of supporting members 112 (e.g., three, four, or five or more, etc.) that extend upwards from the body 115. The body 115 can include one or more retention mechanisms to couple the baseball holder 110 to a stand 120 of the batting tee. In one example, the retention mechanisms of the body 115 can enable the body 115 to be coupled to and be detachable from the stand 120, while enabling the body 115 to be rotated about the stand 120. Each of the plurality of supporting members 112 includes a first end to couple to the base 115 and a second end (or upper end) 113 to make contact with a baseball 130. The upper ends 113 of the plurality of supporting members 112 are spaced apart from each other to suspend the baseball 130. The supporting members 112 can be formed of a resilient material that is semi-rigid (e.g., semi-flexible) so that a supporting member 112 can be flexed without permanent deformation.

For example, the supporting members 112 can be formed of a resilient material, such as a type of plastic, rubber, or combination of materials, so that one or more of the supporting members 112 can be flexed or moved into a loaded position (e.g., a loaded state) when suspending the baseball 130. When the baseball holder 110 is in the loaded position, the upper ends 113 of the supporting members 112 can be flexed or moved further away from each other to make contact with the surface of the baseball 130. In some examples, a sufficient amount of friction can exist between the surface of the baseball 130 and the upper ends 113 in order for the supporting members 112 to hold or suspend the baseball 130 without the baseball 130 from sliding off baseball holder 130. The upper ends 113 of the supporting members 112 can be further apart from each other, for example, than the first ends of the supporting member 112, which are coupled to the body 115.

The supporting members 112 can also have different shapes and/or sizes depending on different implementations. For example, in FIGS. 1A-1B, the supporting members 112 have an elongated shape where the upper ends 113 are curved or rounded. The cross section of the supporting members 112 can be rectangular, triangular, cylindrical, elliptical, or trapezoidal, etc., in shape, and the upper ends 113 can have different sizes or shapes. In one example, the upper ends 113 can be a spherical shape or be a flat shaped end. The baseball holder 110 can also have supporting members 112 of different shapes or sizes (e.g., there can be five supporting members 112, with two of the supporting members 112 being different than the other three).

The supporting members 112 can cooperate to define an unimpeded zone 145, which is an area that is void of support or open, to enable the baseball 130 to travel without being impeded when it is struck by a bat. In some examples, the unimpeded zone 145 favors an exit direction to enable the baseball 130 to be struck in a direction 150 having at least a partially downward trajectory. In this manner, a batter can hit the baseball 130 with a partially downward swing to enable the baseball 130 to travel downwards and away from the batting tee to generate ground balls (e.g., the baseball 130 can spin off of the second ends 113 and move at a velocity towards the ground or field).

Figure 1B:
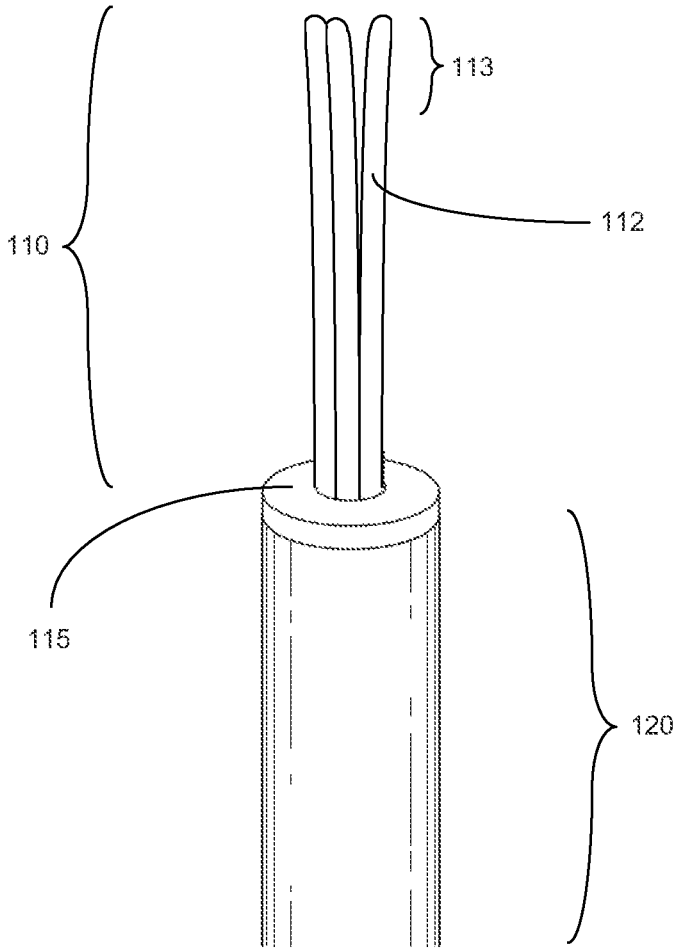

Once the baseball 130 is struck off the baseball holder 110 (or removed from the baseball holder 110), the supporting members 112 can return to an unloaded position (e.g., an unloaded state), such as illustrated in FIG. 1B. In some implementations, when the supporting members 112 are in the unloaded position, the upper ends 113 of the supporting members 112 can be closer to each other than in the loaded position. Because the supporting members 112 can be formed of a resilient material, the supporting members 112 can be struck by a bat and would not be permanently deformed or damaged. For example, the supporting members 112 can be struck (e.g., when the batter is hitting the baseball 130) and be temporarily deformed (e.g., flexed or moved relative to the body 115 in one or more directions), but return to an original, relaxed unloaded position, such as shown in FIG. 1B.

In different implementations, the supporting members 112 can be structured so that the loaded position of the supporting members 112 can be substantially the same as the unloaded position. For example, the spacing between the upper ends 113 of the supporting members 112 in FIG. 1A can remain substantially the same even after the baseball 130 is struck off the baseball holder 110.

Figure 1C:
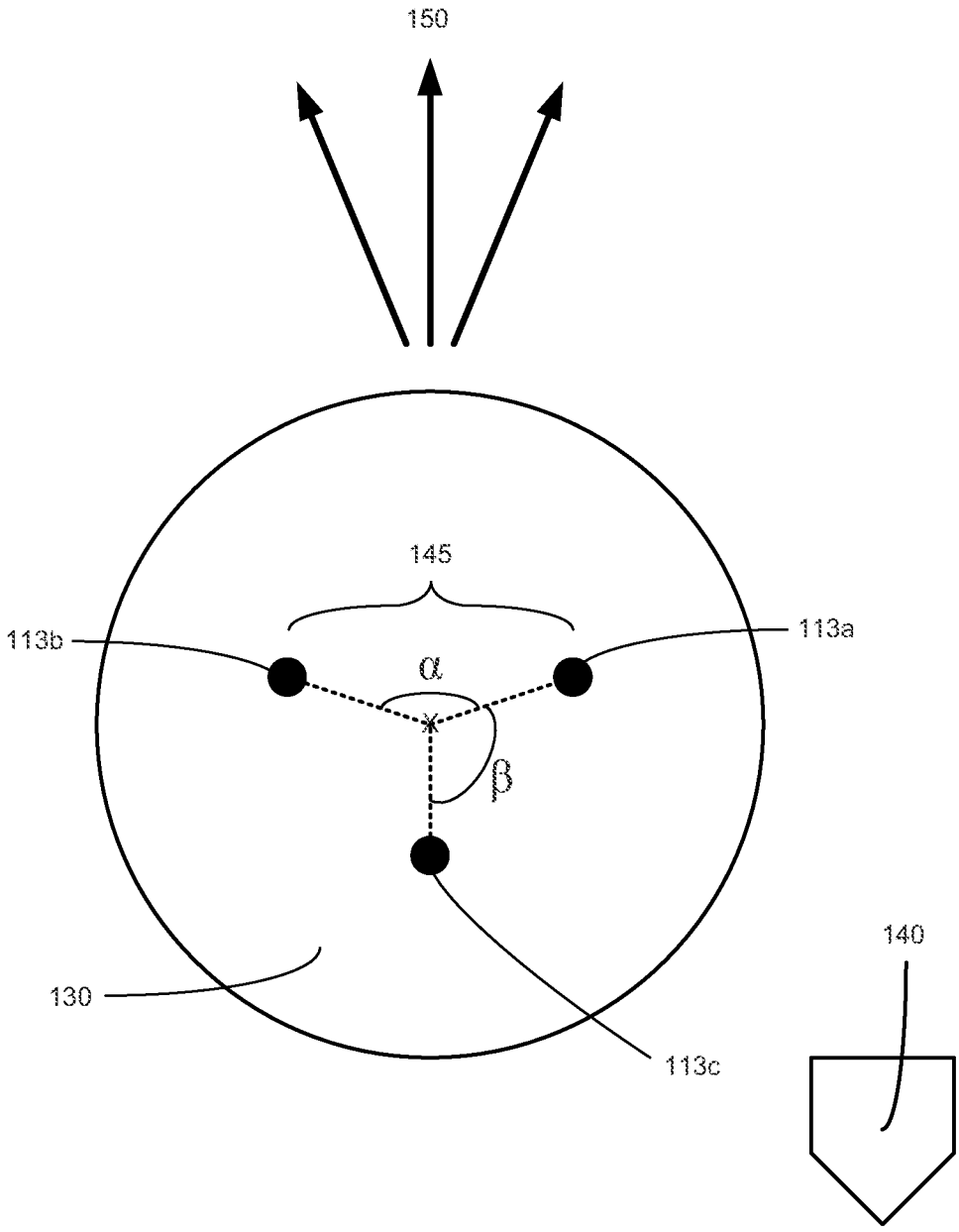

FIG. 1C illustrates a top view of a baseball 130 being suspended by the baseball holder 110. For illustrative purposes, FIG. 1C shows the contact points of the upper ends 113 on the surface of the baseball 130. FIG. 1C also includes a depiction of a home plate 140 to illustrate the position of the baseball holder 110 (and the respective batting tee, not shown) relative to the home plate 140 and a corresponding baseball field. As seen in the corresponding FIG. 1A, the upper ends 113 of the supporting members 112 make contact with the baseball 130 to suspend the baseball 130 on the baseball holder 110.

When the supporting members 112 are in a loaded position to suspend the baseball 130, they can cooperate with each other to define the unimpeded zone 145. An unimpeded zone 145 can be positioned between different supporting members 112 (e.g., depending on user preference). The unimpeded zone 145 can be defined by a distance between two respective upper ends 113*a* and 113*b*, and an angle, $\alpha$, at the center of the baseball holder 110, between the two respective upper ends 113*a* and 113*b*. In some examples, the angle, $\alpha$, can be greater than the angle, $\beta$, between upper ends 113*b* and 113*c*. In some cases, the positions of the upper ends 113 can be varied or manipulated by the user (e.g., change the distances or angles $\alpha$, $\beta$) to change the position of the baseball 130 relative to the baseball holder 110. For example, in FIG. 1C, the supporting members 112 are not positioned to be radially symmetric.

In one implementation, the unimpeded zone 145 is positioned relative to the home plate 140 to enable the baseball 130 to be struck and travel in one or more directions 150 (e.g., generally towards the bases and the outfield). The unimpeded zone 145 favors an exit direction to enable the baseball 130 to be struck in that direction while having at least a partially downward trajectory. In this manner, batters can practice hitting ground balls towards the field (e.g., practice swings having at least a partially downward motion), and fielders can practice fielding ground balls (e.g., as opposed to fielding pop-ups or fly balls).

In some examples, the baseball holder 110 can be configured to enable a user to change the position of the baseball holder 110 relative to the batting tee so that the user can after the directions 150 in which the baseball 130 can travel. For example, the user can rotate the entire batting tee or rotate the baseball holder 110 relative to the batting tee thirty degrees to the left so that the baseball 130 can travel more towards left field (e.g., towards the area between second and third base) when it is struck by a bat.

Figure 2A:
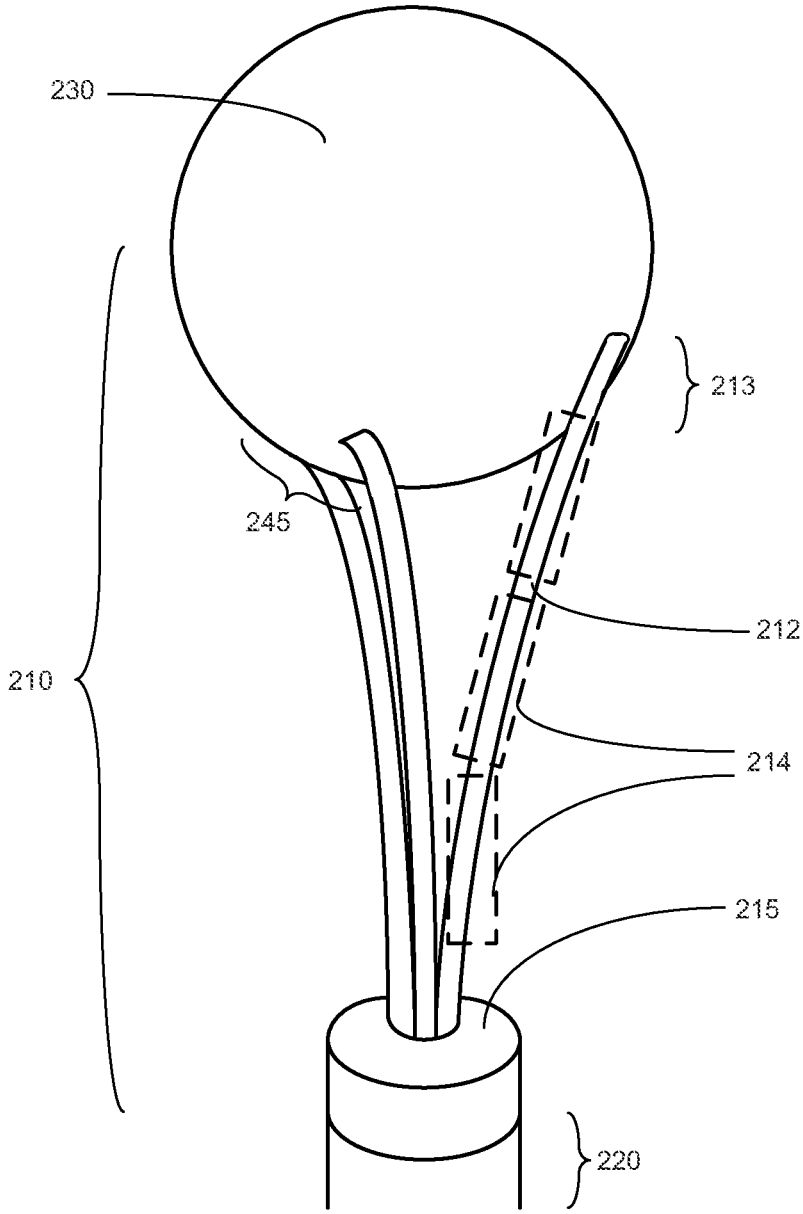
FIGS. 2A-2C illustrate an example baseball holder for a batting tee under different views.
Figure 2B:
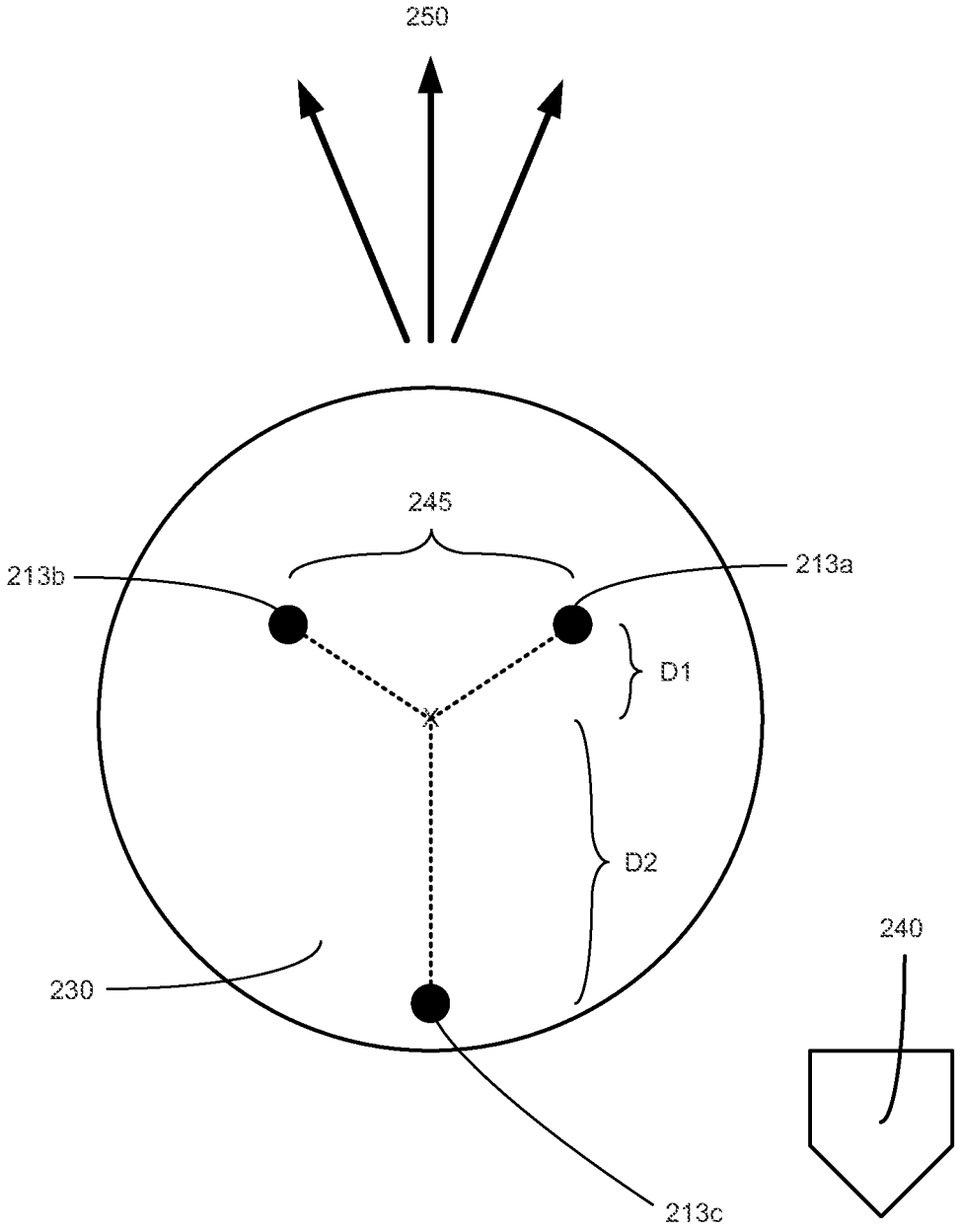
Figure 2C:
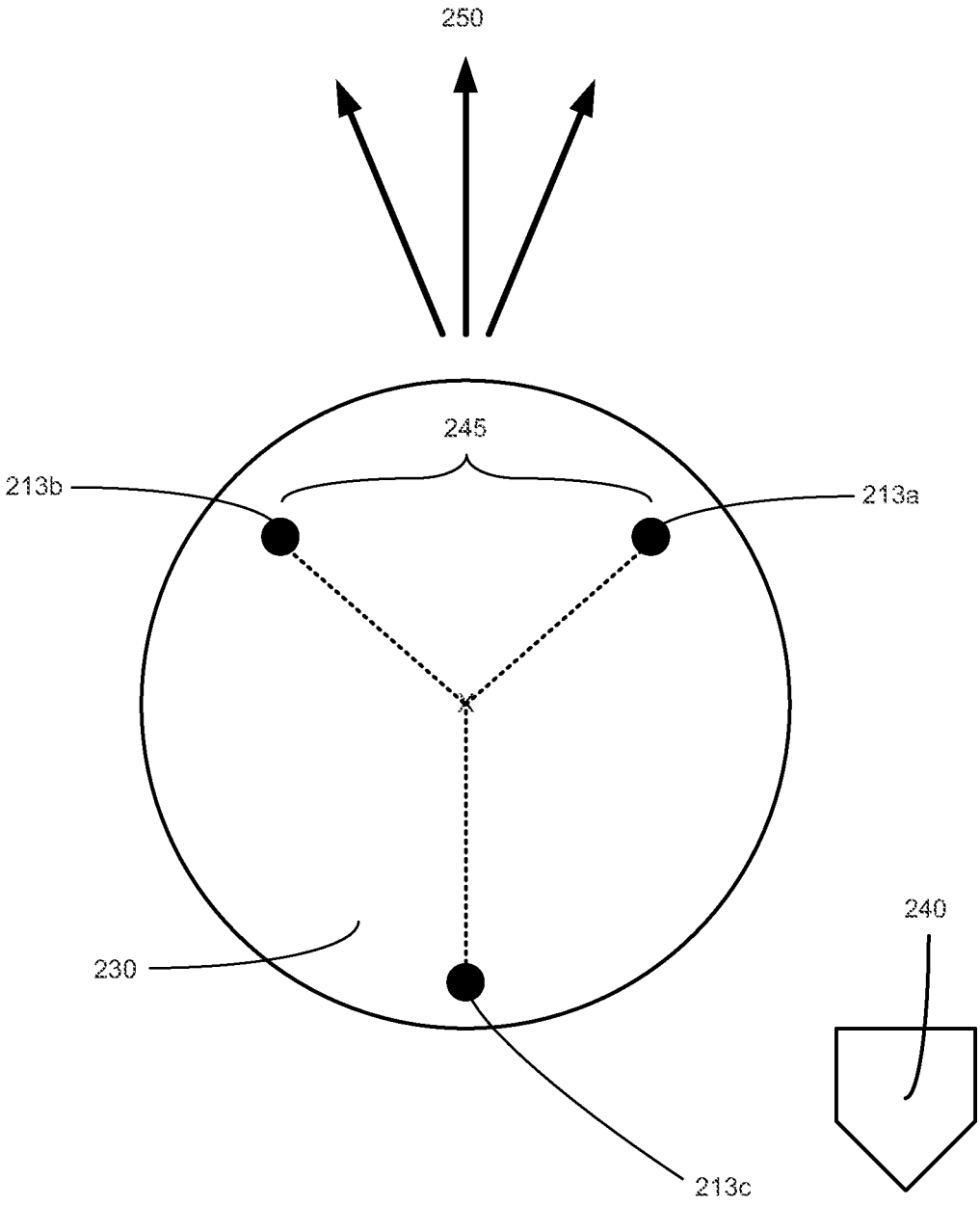

FIGS. 2A-2C illustrate an example baseball holder for a batting tee under different views. FIG. 2A illustrates a baseball holder 210 that includes a body 215 and a plurality of supporting members 212 that extend from the body 215. The baseball holder 210 is similar to the baseball holder 110 described in FIGS. 1A-1C, except one or more supporting members 212 can have a length (or height relative from the body 215) that is greater than the length of another one of the supporting members 212.

The baseball holder 210 can be coupled to the stand 220 of the batting tee via the body 215. Each of the supporting members 212 can include an upper end 213 to make contact with the surface of the baseball 230 (or softball, etc.) to suspend the baseball 230 on the baseball holder 210. In one example, the baseball holder 210 can include three supporting members 212, where one of the supporting members 212 can be longer than the other two supporting members 212. The supporting members 212 can cooperate with each other when suspending the baseball 230 to define an unimpeded zone 245 to enable the baseball 230 to travel in a downward direction without being impeded when it is struck by a bat.

For example, FIG. 2B, which illustrates a top view of the baseball 230 being suspended by the baseball holder 210 in FIG. 2A, shows that the upper end 213*c* of the longer supporting member 212 is positioned at a distance, D2, from the center of the baseball holder 212. The distance, D2, is further from the center than the distance, D1, of the upper ends 213*a*, 213*b* of the other two supporting members 212. In some implementations, each of the supporting members 212 can be formed by segments 214 (e.g., instead of a single segment), such as illustrated in FIG. 2A, to enable individual supporting members 212 to be adjusted in length. The longer supporting member 212 can provide additional support for holding the baseball 230 in place and enable the user to visually distinguish which supporting members 212 should be flexed or moved to define the unimpeded zone 245. In this manner, the baseball 230 can be hit in one or more directions 250 (e.g., as a result of the unimpeded zone 245) relative to the home plate 240 to generate a trajectory toward the infield and outfield.

FIG. 2C illustrates a different example of a top view of the baseball holder 230 when the baseball 230 is suspended by the supporting members 212. FIG. 2C is similar to FIG. 2B, except that the upper ends 213*a*, 213*b* of the supporting members 212 are moved further away from each other to create a larger unimpeded zone 245 (e.g., the supporting members 212 are flexed more than the supporting members 212 of FIG. 2B). For example, the loaded position of the supporting members 212 in FIG. 2C enable the baseball 230 to rest further down on the baseball holder 210 (e.g., be positioned closer to the body 215) than the loaded position of the supporting members 212 in FIG. 2B.

Figure 3B:
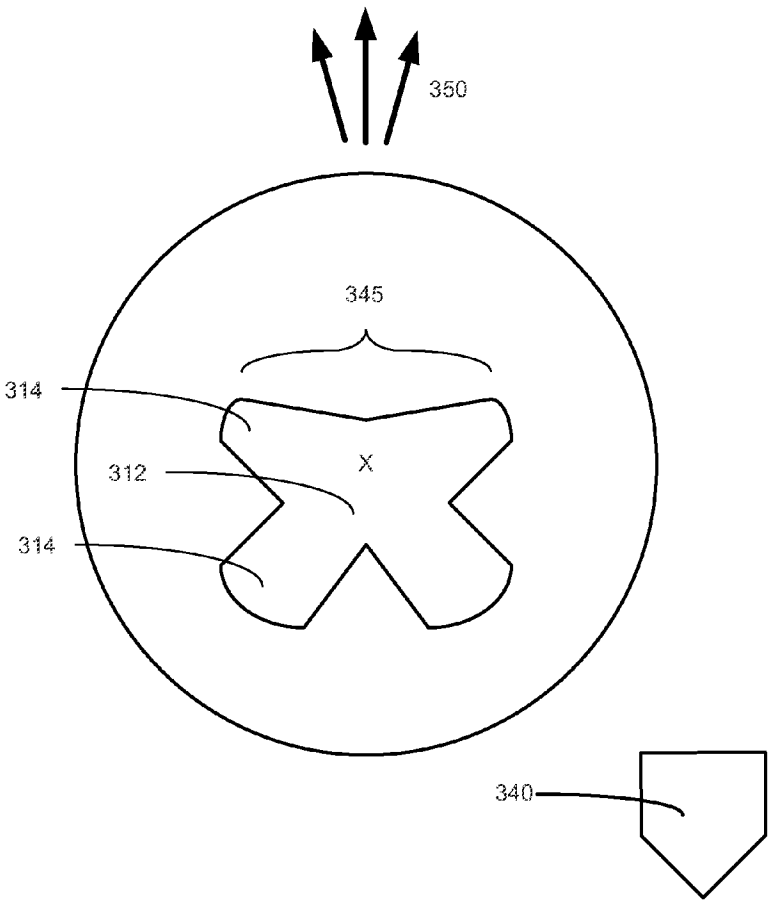
FIGS. 3A-3B illustrate an example baseball holder for a batting tee under different views.
Figure 3A:
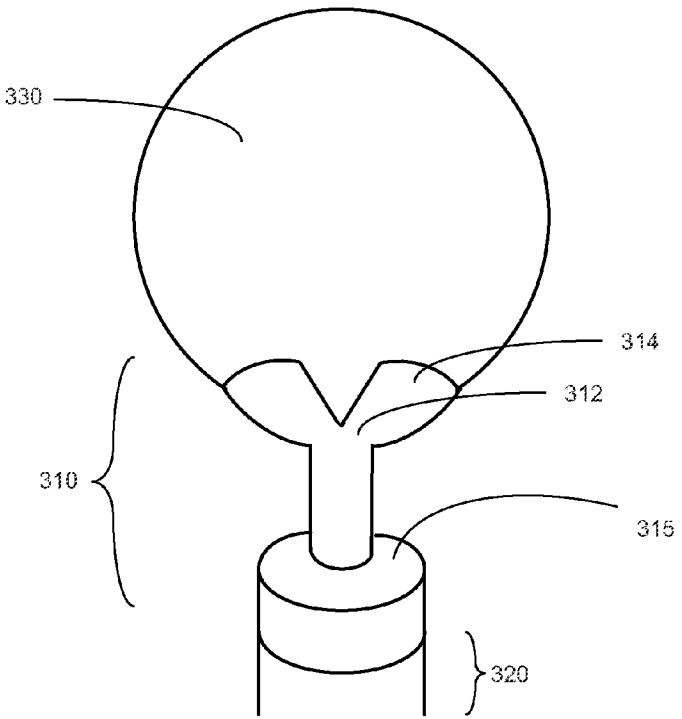

FIG. 3A illustrates an example baseball holder for a batting tee, and FIG. 3B illustrates a top view of the baseball holder 310 in FIG. 3A. In FIG. 3A, the baseball holder 310 includes a body 315 to couple to the stand 320 of the batting tee and a supporting member 312 to suspend a baseball 330. The supporting member 312 can extend from the body 315 and be formed of a singular resilient material. The supporting member 312 can also be shaped as a cone or cup in which the baseball 330 can rest in. For example, the surface of the supporting member 312, in which the baseball 330 rests in, can be curved to match the curvature of the baseball 330.

The supporting member 312 can include one or more extended support portions 314 for suspending the baseball 330 while defining an unimpeded zone 345 that enables the baseball 330 to be hit in a particular direction 350 (e.g., the unimpeded zone is not illustrated in FIG. 3A for simplicity, but can be seen in FIG. 3B). For example, the extended support portions 314 can behave similarly to the supporting members of the baseball holders described in FIGS. 1A-2C.

Figure 4B:
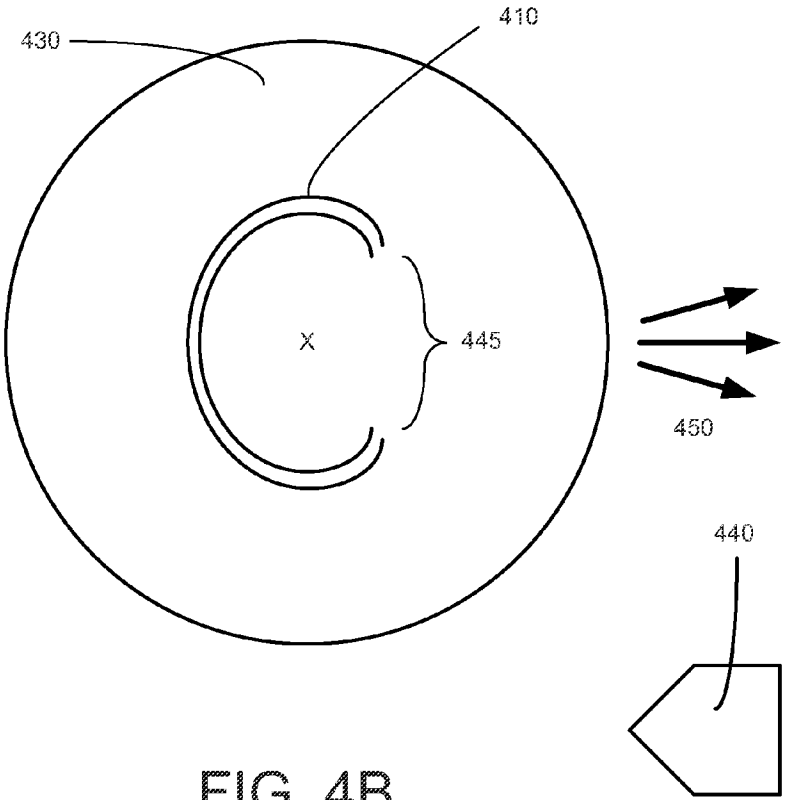
FIGS. 4A-4B illustrate an example baseball holder for a batting tee under different views.
Figure 4A:
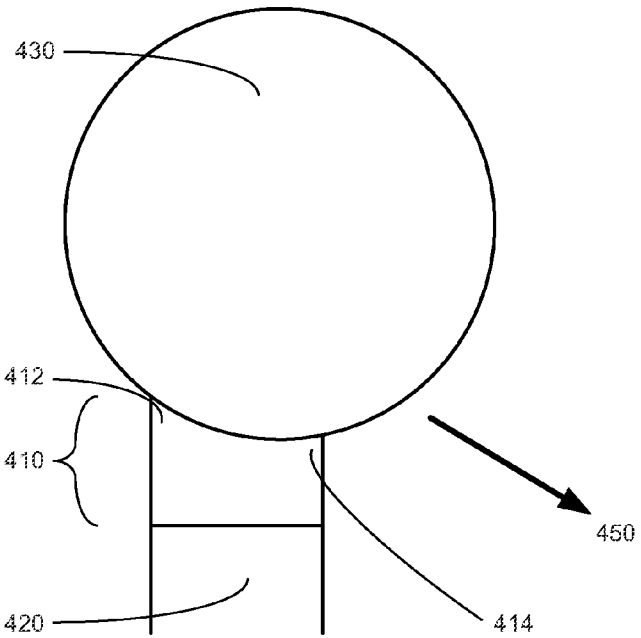

FIG. 4A illustrates an example baseball holder for a batting tee, and FIG. 4B illustrates a top view of the baseball holder 410 in FIG. 4A. In some variations, the baseball holder 410 can be formed of a singular resilient material, such as a cylinder or C-shaped tube, having an upper portion 412 and a lower portion 414. The baseball holder 410 of FIGS. 4A-4B can be shaped to suspend a baseball 430 (e.g., be curved in shape), while defining an unimpeded zone 445 to enable the baseball 430 to be struck in the direction 450. The direction 450 has at least a downward trajectory to generate a ground ball when the baseball 430 is struck off the baseball holder 410 (e.g., a direction relative to the home plate 440 in FIG. 4B). The unimpeded zone 445 can be positioned towards the lower portion 414 of the baseball holder 410. Like the baseball holders described in FIGS. 1A-3, the baseball holder 410 can be rotated about the stand 420 to alter the direction(s) 450 in which the baseball 430 can be hit in.

Figure 5:
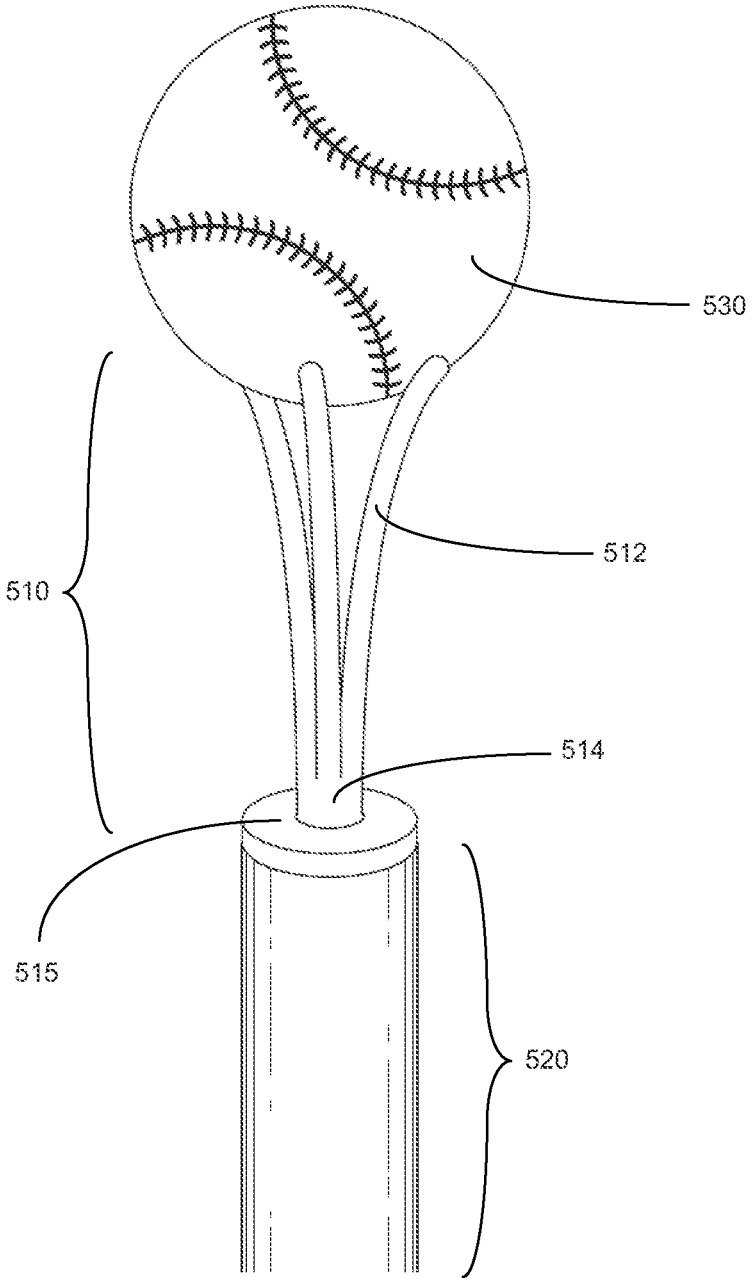
FIG. 5 illustrates an example baseball holder for a batting tee.

FIG. 5 illustrates an example baseball holder for a batting tee. In FIG. 5, the baseball holder 510 is composed of a body 515 to couple to the stand 520 of the batting tee and a supporting structure 514 that extends from the body 515. In contrast with the baseball holder 110 of FIGS. 1A-1C, for example, the supporting structure 514 is formed of a singular resilient material and includes a plurality of supporting members 512. That is, each supporting member 512 is not separate from each other, but are connected together at a lower end to couple to the body 515. The supporting members 512 can flex to move between a loaded position (e.g., when suspending the baseball 530) and an unloaded position, similar to the supporting members described in FIGS. 1A-1C.

As an addition or alternative, in each of the figures described, the body of the baseball holder can be coupled to a joint to enable the baseball holder to pivot relative to the stand of the batting tee (see joint 117 of FIG. 1A, for example). This enables the user to vary the angle in which a baseball is suspended by the baseball holder to alter the velocity or angle of baseball when it is struck off the baseball holder by a bat (e.g., the user can generate different ground balls).

In some variations, the baseball holder can be integrated with the batting tee (e.g., so that it cannot be detached from the stand of the batting tee). In other embodiments, the batting tee can include a stand that can couple to various types of baseball holders. For example, the baseball holders described in FIGS. 1A-5 can be detached from the stand, and different types of baseball holders can be coupled to the stand depending on user preference. A user, for example, can couple a standard baseball holder (e.g., such as a typical cup) for hitting a ball in the air, and then exchange the standard baseball holder with the baseball holder 110 of FIG. 1A.

The batting tee can also be structure to be adjusted in height. For example, the stand of the batting tee can be formed of a number of segments that can move about each other to extend or shorten the length of the stand. In some implementations, the body of the baseball holder (e.g., the body described by FIGS. 1A-5) can also be formed of two or more segments that can move about each other so that the user can adjust the length of the body (e.g., instead of adjusting the stand of the batting tee) to change the height of the batting tee.

It is contemplated for embodiments described herein to extend to individual elements and concepts described herein, independently of other concepts, ideas or system, as well as for embodiments to include combinations of elements recited anywhere in this application. Although embodiments are described in detail herein with reference to the accompanying drawings, it is to be understood that the invention is not limited to those precise embodiments. As such, many modifications and variations will be apparent to practitioners skilled in this art. Accordingly, it is intended that the scope of the invention be defined by the following claims and their equivalents. Furthermore, it is contemplated that a particular feature described either individually or as part of an embodiment can be combined with other individually described features, or parts of other embodiments, even if the other features and embodiments make no mentioned of the particular feature. Thus, the absence of describing combinations should not preclude the inventor from claiming rights to such combinations.

What is claimed is:

1. A baseball holder for a batting tee comprising:

a body to couple the baseball holder to the batting tee; and three or more supporting members that extend out from the body to suspend a baseball, each of the three or more supporting members including a first end to couple to the body and a second end, the second ends of the three or more supporting members being spaced apart from each other to suspend the baseball for hitting, wherein the three of more supporting members cooperate to define an unimpeded zone to enable the baseball to be struck off the baseball holder in a direction having at least a partially downward trajectory, wherein at least one of the three or more supporting members is adjustable in length.

2. The baseball holder of claim 1, wherein the body is detachable from the batting tee.

3. The baseball holder of claim 1, wherein the body can be rotated on the batting tee to enable the baseball to be hit off the baseball holder in any one of a plurality of directions.

4. The baseball holder of claim 1, wherein the three or more supporting members is formed of a resilient material so that the three or more supporting members move to a loaded position when suspending the baseball, and when the baseball is not suspended by the three or more supporting members, each of the second ends of the three or more supporting members return to an unloaded position.

5. The baseball holder of claim 1, wherein the body includes one or more retention mechanisms to couple the baseball holder to the batting tee.

6. The baseball holder of claim 1, wherein a distance between the first ends of two supporting members is smaller than the distance between the second ends of the two supporting members when the second ends of the three or more supporting members suspend the baseball.

7. The baseball holder of claim 1, wherein at least one of the three or more supporting members has a length that is greater than another of the three or more supporting members.

8. A batting tee comprising:

a base;

a stand; and a baseball holder including a body to couple the baseball holder to the stand, and a plurality of supporting members that extend out from the body to suspend a baseball, each of the plurality of supporting members including a first end to couple to the body and a second end, the second ends of the plurality of supporting members being spaced apart from each other to suspend the baseball for hitting, wherein the plurality of supporting members cooperate to define an unimpeded zone to enable the baseball to be struck off the baseball holder in a direction having at least a partially downward trajectory, wherein the plurality of supporting members includes three or more supporting members, and wherein at least one of the three supporting members is adjustable in length.

9. The batting tee of claim 8, wherein the body of the baseball holder is coupled to a joint to enable the baseball holder to pivot about the joint.

10. The batting tee of claim 8, wherein the body can be rotated on the stand to enable the baseball to be hit off the baseball holder in a plurality of directions.

11. The batting tee of claim 8, wherein the plurality of supporting members is formed of a resilient material so that the plurality of supporting members move to a loaded position when suspending the baseball, and when the baseball is not suspended by the plurality of supporting members, each of the second ends of the plurality of supporting members return to an unloaded position.

12. The batting tee of claim 8, wherein a distance between each of the first ends of two supporting members is smaller than the distance between the second ends of the two supporting members when the second ends of the plurality of supporting members suspend the baseball.

13. The batting tee of claim 8, wherein at least one of the three supporting members has a length that is greater than another of the three supporting members.

14. The batting tee of claim 8, wherein the stand is adjustable in height.

* * * * *